US009391402B2

(12) United States Patent
Lin

(10) Patent No.: US 9,391,402 B2
(45) Date of Patent: Jul. 12, 2016

(54) FASTENING APPARATUS FOR SECURING A CONNECTOR TO AN ELECTRONIC DEVICE

(71) Applicant: ATEN International Co., Ltd., New Taipei (TW)

(72) Inventor: Wei-Fan Lin, Taipei (TW)

(73) Assignee: ATEN INTERNATIONAL CO., LTD., New Taipei (TW)

( * ) Notice: Subject to any disclaimer, the term of this patent is extended or adjusted under 35 U.S.C. 154(b) by 0 days.

(21) Appl. No.: 14/491,687

(22) Filed: Sep. 19, 2014

(65) Prior Publication Data

US 2015/0340809 A1 Nov. 26, 2015

(30) Foreign Application Priority Data

May 26, 2014 (TW) ..... 103118329 A

(51) Int. Cl.

| | |
|---|---|
| ***H01R 13/62*** | (2006.01) |
| ***H01R 13/639*** | (2006.01) |
| ***H01R 9/18*** | (2006.01) |
| *H01R 13/50* | (2006.01) |

(52) U.S. Cl.

CPC ..... *H01R 13/639* (2013.01); *H01R 9/18* (2013.01); *H01R 13/6395* (2013.01); *H01R 13/501* (2013.01)

(58) Field of Classification Search

CPC ..... H01R 13/639; H01R 9/18

USPC ..... 439/314, 332, 345, 371, 373, 449, 456, 439/501

See application file for complete search history.

(56) References Cited

U.S. PATENT DOCUMENTS

| | | | | |
|---|---|---|---|---|
| 3,163,481 | A | 12/1964 | Salvador | |
| 3,960,432 | A | 6/1976 | Wilbur | |
| 5,348,495 | A * | 9/1994 | Kasden | H01R 13/6395 439/371 |

(Continued)

FOREIGN PATENT DOCUMENTS

| | | |
|---|---|---|
| CA | 978619 | 11/1975 |
| CN | 102005671 | 4/2011 |

(Continued)

OTHER PUBLICATIONS

"Dayton Audio SupraLok Connector Pair for Signature HDMI Cables", Parts Express, http://www.parts-express.com/dayton-audio-supralok-connector-pair-for-signature-hdmi-cables--181-729, 5 pages, printed from the internet on Sep. 15, 2014.

(Continued)

*Primary Examiner* — Abdullah Riyami
*Assistant Examiner* — Nelson R Burgos-Guntin
(74) *Attorney, Agent, or Firm* — Chen Yoshimura LLP

(57) ABSTRACT

The present invention provides a fastening apparatus for retaining a connector coupled to an electronic device. The fastening apparatus for connector comprises a first fixing portion, a connection portion and a second fixing portion. The first fixing portion is disposed at one side of a connector and has a first binding unit. The connection portion is formed on the fixing portion to connect the first fixing portion to a housing of an electronic device. The second fixing portion is pivotally rotatable relative to the first fixing portion, the second fixing portion including a second binding unit which is engages with the first binding unit when the second fixing portion rotates to a particular location, so that a cable of the connector is enclosed between the first fixing portion and the second fixing portion.

20 Claims, 10 Drawing Sheets

(56) References Cited

U.S. PATENT DOCUMENTS

| | | | | |
|---|---|---|---|---|
| 5,782,648 | A | 7/1998 | Peterson | |
| 6,071,142 | A | 6/2000 | Blackman | |
| 6,811,415 | B2 * | 11/2004 | Chen | H01R 13/6397 439/133 |
| 6,966,792 | B1 * | 11/2005 | Willers | H01R 13/73 439/373 |
| 7,140,903 | B2 | 11/2006 | Pulizzi et al. | |
| 7,207,826 | B1 | 4/2007 | Yang | |
| 7,455,546 | B1 | 11/2008 | Yoon et al. | |
| 7,927,126 | B1 | 4/2011 | Bender | |
| 7,963,792 | B2 | 6/2011 | Sawada et al. | |
| 8,613,629 | B2 * | 12/2013 | Gong | H01R 13/6395 439/371 |
| 8,926,358 | B2 * | 1/2015 | Kuo | H01R 13/629 439/367 |
| 2002/0068477 | A1 * | 6/2002 | Chen-Chiang | H01R 13/6395 439/373 |
| 2002/0182917 | A1 * | 12/2002 | Kerr, Jr. | F21V 21/02 439/314 |
| 2004/0008839 | A1 | 1/2004 | Jozitis et al. | |
| 2004/0121646 | A1 * | 6/2004 | Iamartino | G02B 6/3829 439/445 |
| 2006/0046557 | A1 * | 3/2006 | Pulizzi | H01R 13/5804 439/371 |
| 2008/0076291 | A1 * | 3/2008 | Ewing | H01R 13/5812 439/373 |
| 2012/0171883 | A1 | 7/2012 | Shu | |
| 2012/0225578 | A1 * | 9/2012 | Adams | H01R 13/6392 439/373 |
| 2014/0141649 | A1 * | 5/2014 | Standish | G06K 7/10415 439/620.01 |
| 2014/0242830 | A1 * | 8/2014 | Garofalo | H01R 13/6395 439/373 |
| 2015/0044896 | A1 * | 2/2015 | Davies | H01R 13/62 439/345 |
| 2015/0099394 | A1 * | 4/2015 | Ikeya | H01R 12/724 439/533 |
| 2015/0280363 | A1 * | 10/2015 | Rynaski | H01R 13/639 439/371 |

FOREIGN PATENT DOCUMENTS

| | | |
|---|---|---|
| TW | M286489 | 1/2006 |
| TW | M304814 | 1/2007 |
| TW | I340509 | 4/2011 |

OTHER PUBLICATIONS

"LockIt® HDMI Cable Lacing Bracket", Extron Electronics, http://www.extron.com/product/product.aspx?id=lockit, 1 page, printed from the internet on Sep. 15, 2014.

"hd EZ lock™", Blue Echo Solutions, Inc., http://www.blueechosolutions.com/proddetail.php?prod=hd-ez-lock, 4 pages, printed from the internet on Sep. 15, 2014.

European Search Report in counterpart application EP 14195152.5, dated Aug. 14, 2015.

* cited by examiner

FASTENING APPARATUS FOR SECURING A CONNECTOR TO AN ELECTRONIC DEVICE

TECHNICAL FIELD

The present invention generally relates to an apparatus for preventing a connector or a plug from detachment, and more particularly, to an apparatus for fastening connectors or plugs of a cable to an electronic device.

BACKGROUND

Electronic devices, such as consumer electronics, play an important role in our daily life, and electrical power is required to operate these devices. Most of the electronic devices receive required power through plug electrically connected to an outlet. Besides, cable, for instance, HDMI, USB cables, and etc., may also be employed to transmit electrical signals through connectors thereof to electrically couple to different electronic devices. The connectors or plugs can potentially be loosened or disengaged from the electronic devices due to an inadvertent or unintentional external force generated from vibration, pulling, or collision, thereby causing the electronic device to stop working.

In order to secure the plugs or connectors to the socket or electronic devices, conventionally, a securing force naturally formed by close fit between the plugs and sockets or female and male connectors without assistance of accessory is utilized to prevent the plug or connector from being loosened or disengaged. However, the securing effect of such conventional way will be reduced after a certain number of plugging and removing cycles or due to improper usage. Further, if a part of the cable near the connector coupled to the electronic device has higher bending curvature, or thicker cables with heavy weight are used, a pulling force may be generated to reduce the securing effect between the connector and the electronic device or between plug and socket. In worse case, the plug or connector will be detached from the electronic device or socket whereby the electronic device will be ceased in a sudden, and is likely to be damaged due to lost of power supply or electrical signal.

To overcome such problems, prior U.S. Pat. No. 7,207,826 and U.S. Pat. No. 7,140,903 disclose a fastening device or apparatus comprising two or more separate elements for securing the plug or connector to the device. However, the fastening device or apparatus is too complicated to make installation and detachment. In addition, the prior fastening devices are hardly adapted to fit different size of connectors or plugs. Furthermore, in conventional art, although the fastening device or apparatus can provide a better securing effect, since the cable is not completely secured by the fastening device or apparatus, there still is a possibility that the plug or connector could be detached from the device while the cable is pulled by external force.

In order to solve the problem of the conventional arts, there is a need and focus in the related industry to provide an apparatus to secure the plug or connector to the device.

SUMMARY OF THE INVENTION

An object of the present invention is to provide an apparatus to prevent connectors from being loosened or disengaged from the device electrically coupled thereto.

Another object of the present invention is to provide an apparatus with an improvement of fastening capability for enhancing the securing effect.

A further object of the present invention is to provide an integrally formed fastening apparatus for reducing the cost of manufacturing.

A further object of the present invention is to provide an apparatus with simplified installation and detachment mechanism which is also reusable as well as adaptable to connectors or plugs having different sizes.

According to one embodiment of the present invention, the present invention provides a fastening apparatus for securing a connector to an electronic device, comprising a first fixing portion, arranged at one side of the connector, the first fixing portion further having a first binding unit; a connection portion, coupled to the first fixing portion to connect the first fixing portion to a housing of the electronic device; and a second fixing portion pivotally connected with the first fixing portion, the second fixing portion further comprising a second binding unit which is engaged with the first binding unit when the second fixing portion pivots to a specific location such that a cable of the connector is enclosed between the first fixing portion and the second fixing portion.

According to another embodiment of the invention, the first fixing portion or the second fixing portion comprises at least a concave part to form the at least one through hole when the first binding unit is engaged with the second binding unit.

According to another embodiment of the present invention, the connection portion comprises a holder for receiving the first fixing portion and an opening on the holder to receive a screw to fasten the holder to the housing, wherein a location of the first fixing portion on the holder is adjustable.

According to another embodiment of the invention, the first binding unit has a hook and the second binding unit has an arm, wherein an accommodating space defined by the arm and the second fixing portion for allowing the hook to be inserted therein, and wherein the arm further comprises a projection formed toward the accommodating space to form a neck port at an opening of the accommodating space. Furthermore, the second binding unit further comprises a positioning pin structure and the first binding unit further comprises a positioning groove, and the positioning pin structure is inserted into the positioning groove when the first binding unit is engaged with the second binding unit.

BRIEF DESCRIPTION OF THE DRAWINGS

The components, characteristics and advantages of the present invention may be understood by the detailed description of the preferred embodiments outlined in the specification and the drawings attached.

DETAILED DESCRIPTION

Some preferred embodiments of the present invention will now be described in greater detail. However, it should be recognized that the preferred embodiments of the present invention are provided for illustration rather than limiting the present invention. In addition, the present invention can be practiced in a wide range of other embodiments besides those explicitly described, and the scope of the present invention is not expressly limited except as specified in the accompanying claims. The layout of components may be more complicated in practice.

Figure 1A:
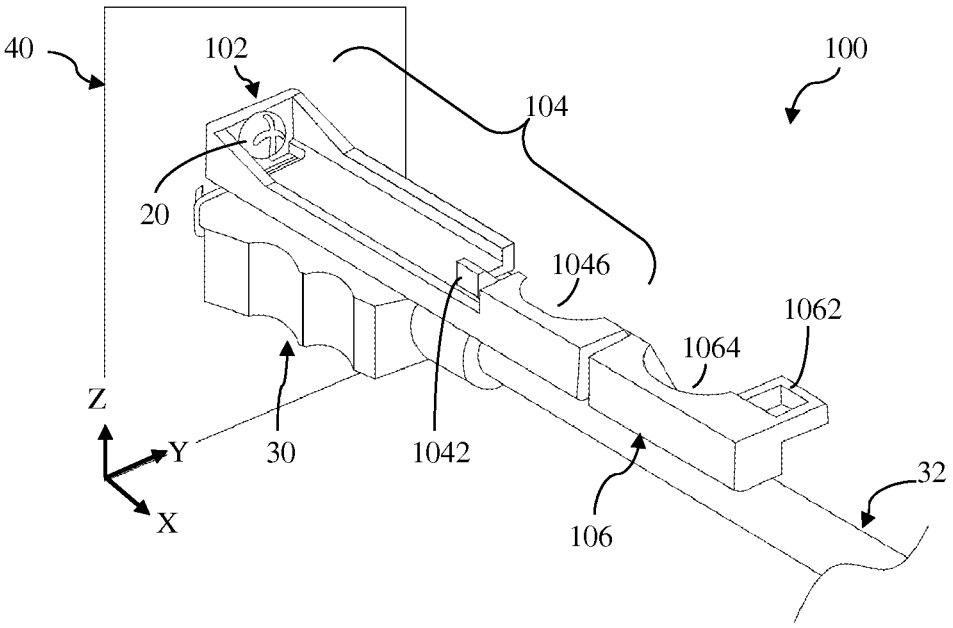
FIG. 1A illustrates a perspective view of an apparatus for fastening connectors according to the first embodiment of the present invention.
Figure 1B:
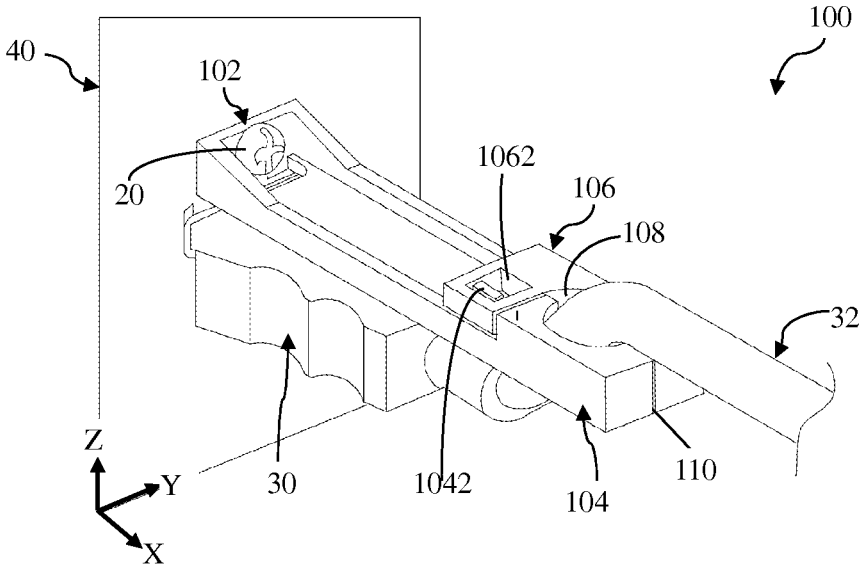
FIG. 1B illustrates a perspective view of an apparatus for fastening the cable of connectors according to the first embodiment of the present invention.

FIG. 1A and FIG. 1B show respectively a perspective view of a secured condition and a released condition between the fastening apparatus and the connector according to the first embodiment of the present invention. In the present embodiment, the apparatus 100 comprises a first fixing portion 104, a connection portion 102 and a second fixing portion 106, that are integrally formed as one unit through molding process such as plastic injection molding. By using this structure, not only can the volume of the apparatus 100 be reduced, but also the complicated and troublesome steps of installing and detachment can be eliminated. In another embodiment, the second fixing portion 106 and the first fixing portion 104 are independent two elements which may be assembled into one piece. In one embodiment, the material for forming the apparatus may be, but is not limited to, plastic or metal materials with excellent strength, flexibility and elasticity properties. The first fixing portion 104 is positioned at a side of a connector 30, such as top, bottom, right or left side, for example. In this embodiment, the apparatus 100 is positioned at the top side of the connector 30 of a cable 32. The connector, in the present invention, refers to a power or signal interface which may connect one electronic device to another electronic device or power source through the cable 32 for establishing a power or signal channel. Examples of the connector include but are not limited to a power plug, video-audio connector (e.g., HDMI or DVI connector), data connector (e.g., USB connector), and so on. In this embodiment, the connector is an HDMI connector. The connection portion 102 is positioned at the front of the first fixing portion 104 so that the first fixing portion 104 could be coupled to a housing 40 of the electronic device through the connection portion 102. The housing 40 can be but is not limited to switch (e.g., KVM switch or video switch), splitter, personal computer, TV or display, and so on. In the present embodiment, the housing 40 includes a socket or connector, e.g., female or male connector, allowing the connector 30 to couple therein so as to maintain the power or signal channel between electronic devices under normal operation.

In one embodiment, the housing 40 and the connection portion 102 respectively have a through hole corresponding to each other. A user may mount the first fixing portion 104 onto the housing 40 by using a screw 20 passing through the through hole of the connection portion 102 and housing 40 to couple in the housing 40 by the threads, as shown in FIG. 1A to FIG. 3. As shown in FIG. 4A and FIG. 4B, they depict an alternative embodiment of the connection portion of the present invention. In this alternative embodiment, the connection portion 102 further includes a first cylindrical structure 1026 and a second cylindrical structure 1028. The first cylindrical structure 1026 is coupled to the front end of the first fixing portion 104 and the second cylindrical structure 1028 is coupled to the first cylindrical structure 1026, wherein the diameter of the second cylindrical structure 1028 is greater than the diameter of the first cylindrical structure 1026. The housing 40 has a hole 1022 and an locking hole 1023, which is extended from the bottom side of the hole 1022, wherein the diameter of the hole 1022 is greater than the diameter of the locking hole 1023 and the diameter of the second cylindrical structure 1028 while the diameter of the second cylindrical structure 1028 is greater than the diameter of the locking hole 1023, whereby the first fixing portion 104 can be fastened to the housing 40 when the second cylindrical structure 1028 passes through the hole 1022 and the first cylindrical structure 1026 is inserted into the locking hole 1023 by pushing the connection portion 102 downwardly. In this alternative mounting structure, the connection portion 102 of the fastening apparatus 100 can be mounted on the housing without any external fixing element, e.g., screw, thereby eliminating the complicated and time-consuming steps of installation and detachment. It should be understood that the connection portion 102 may include but is not limited to the two embodiments as described above. The design for achieving the same effect as the foregoing embodiment can be modified or varied by a person skilled in the art according to the need in use.

Referring to FIG. 1A and FIG. 1B, the first fixing portion 104 and second fixing portion 106 are connected with each other. In the present embodiment, the second fixing portion 106 is pivotally coupled to the first fixing portion 104. For example, there has a flexible element 110 respectively coupled to the first fixing portion 104 and the second fixing portion 106 whereby the second fixing portion 106 can pivotally rotate about the Z axis through the flexible element 110. It is noted that the flexible element 110, the first fixing portion 104 and second fixing portion 106 are integrally formed, which means that the flexible element 110 is undetachable between the first fixing portion 104 and second fixing portion 106. In one embodiment, the first fixing portion 104, second fixing portion 106, and the flexible element 110 can be formed through a molding process, such as injection molding with the same material. In another embodiment, the second fixing portion 106 may be pivoted via a pivotal structure assembly which is not integrally formed with but is coupled to the fist fixing portion 104 and second fixing portion 106. The pivotal structure is well understood by the skilled person in the art, thereby not being further illustrated hereinafter.

The second fixing portion 106 is engaged with the first fixing portion 104 at an engagement location separate from the connecting element 110 when the second fixing portion pivots a specific angle to a specific location such that the cable 32 of the connector 30 is enclosed between the first fixing portion 104 and the second fixing portion 106. In this embodiment, the first fixing portion 104 further comprises a first binding unit 1042, which is a protrusion structure in this embodiment. An end of the second fixing portion 106 further comprises a second binding unit 1062 which is formed as a hole or groove structure for closely matching with the first binding unit 1042 thereby generating a tight fastening effect by which the first binding unit 1042 is engaged with the second binding unit 1062. It is noted that the size and shape of the second binding 1062 depends on the surface profile of first binding unit 1042. For example, the second binding 1062 should be a spherical hole for matching the first binding 1042 having spherical protrusion structure. When the second fixing portion 106 is pivoted to the specific angle, the second binding unit 1062 could be inserted into the first binding unit 1042, so that the first binding unit 1042 of the first fixing portion 104 can be engaged with the second binding unit 1062 of the second fixing portion 106. As shown in FIG. 1A and FIG. 1B, the specific angle that the second fixing portion 106 is pivoted is 180°. In another embodiment, the first binding unit 1042 and the second binding unit 1062 can be swapped, for instance, the second binding unit 1062 can be a protrusion structure, while the first binding unit 1042 can be a hole structure. Such modification in design achieving the same effect as the foregoing embodiment should be well understood by a person skilled in the art according to the need in use, thereby not being illustrated hereinafter.

In one embodiment, the first fixing portion 104 includes a first concave part 1046 and the second fixing portion 106 includes a second concave part 1064. When the second fixing portion 106 is engaged with the first fixing portion 104 at the engagement location, the first concave part 1046 and the second concave part 1064 collectively form a through hole 108. In this embodiment, an axis (shown as Z axis in the drawings) of the through hole 108, formed by the first concave part 1046 and the second concave part 1064, is perpendicular to the normal direction (shown as the X axis in drawings) of a front surface of the housing 40, as shown in FIG. 1B. The through hole 108 is provided to allow the cable 32 of the connector 30 to pass therethrough. In one embodiment, the cable 32 is clamped by the inner wall of the through hole 108 whereby the connector 30 can be securely coupled to the housing 40 by the apparatus 100 so that the connector 30 can maintain the electrical connection with the electronic device coupled therewith even when the external force is exerted on the cable 32 or connector 30. It should be understood that the diameter of the through hole 108 may be slightly smaller than the diameter of the cable 32 to seize the cable 32. Alternatively, the diameter of the through hole 108 may be greater than the diameter of the cable 32 to constrain the cable 32. In this case, although the cabled 32 is not tightly clamped by the through hole 108, the through hole 108 can constrain the movement of the cable 32 such that the connector 30 can be still secured. It is noted that the through hole 108 is not limited to be formed by the way shown as FIG. 1A. For example, in one alternative structure, the first fixing portion 104 has the first concave part 1046 but the second fixing portion 106 does not have the second concave part 1064. Alternatively, the first fixing portion 104 does not have the first concave part 1046 but the second fixing portion 106 has the second concave part 1064. In this alternative embodiment, the through hole 108 can also be formed when the first fixing portion 104 and the second fixing portion 106 are engaged with each other. However, it should be noted that the through hole 108 is not a necessary element for implementing the present invention.

Figure 2:
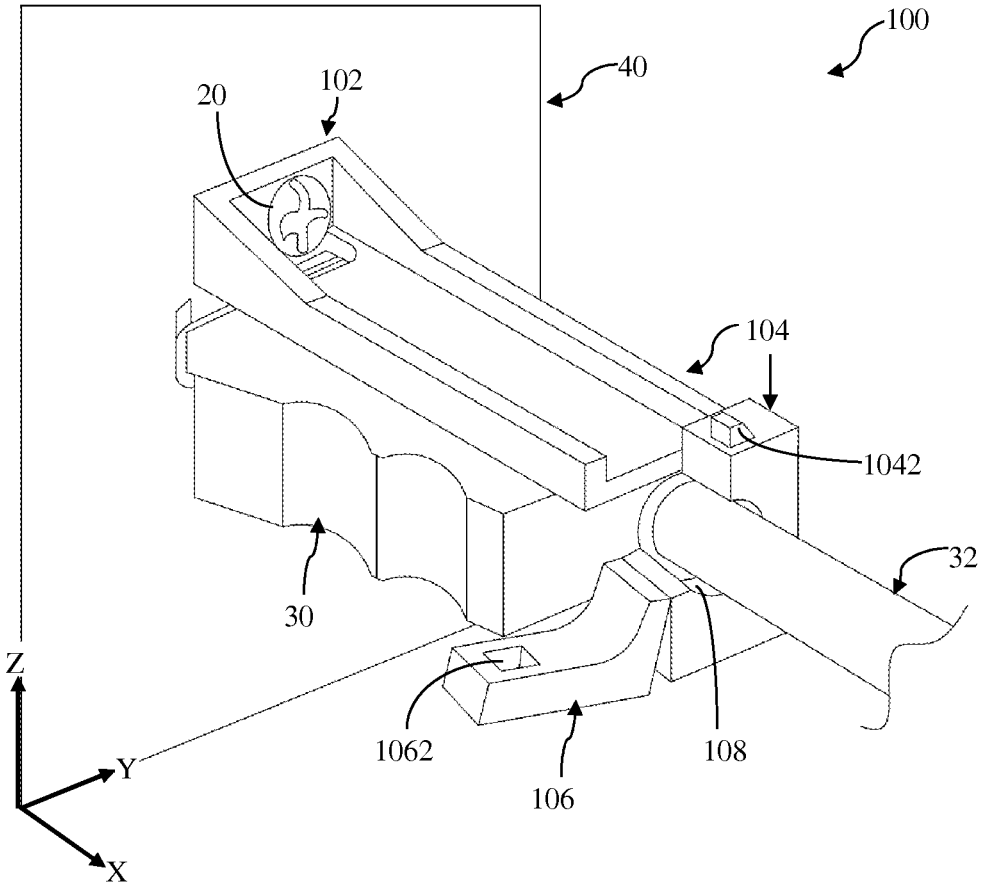
FIG. 2 illustrates a perspective view of an apparatus for fastening connectors according to the second embodiment of the present invention.

The pivotal axis of the second fixing portion 106 is not limited as shown FIG. 1B. For instance, as shown in FIG. 2, the axis of the through hole 108 is parallel to the normal direction of the front surface of the housing 40 (X axial in the drawings), in other words, the pivotal axis of the second fixing portion 106 is parallel to the normal direction of the housing (X axis in drawings). Such modification in design achieving the same effect as the foregoing embodiment should be understood by a person skilled in the art, thereby not being described hereinafter. Besides, in the embodiment shown in FIG. 2, the cable 32 could be clamped by the through hole 108 without comparatively greater bending curvature than the embodiment shown in FIG. 1B whereby the instability of signal or power transmission can be eliminated.

Figure 3:
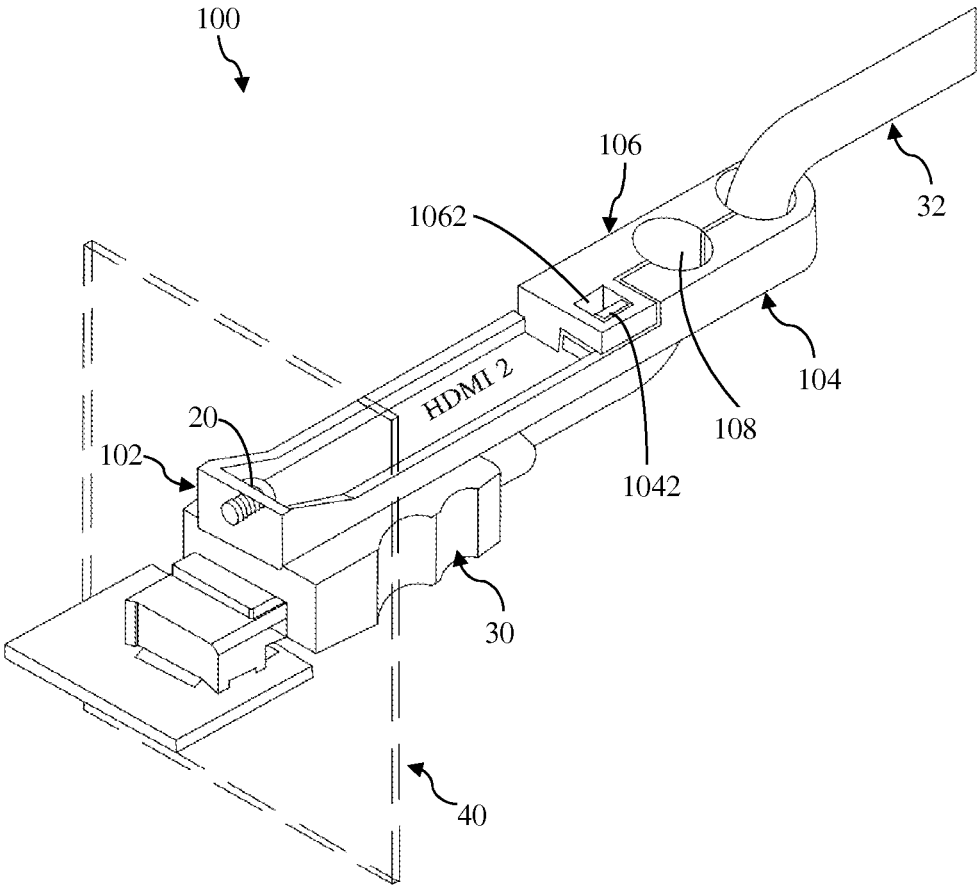
FIG. 3 illustrates a perspective view of an apparatus with labeling according to an embodiment of the present invention.
Figure 4A:
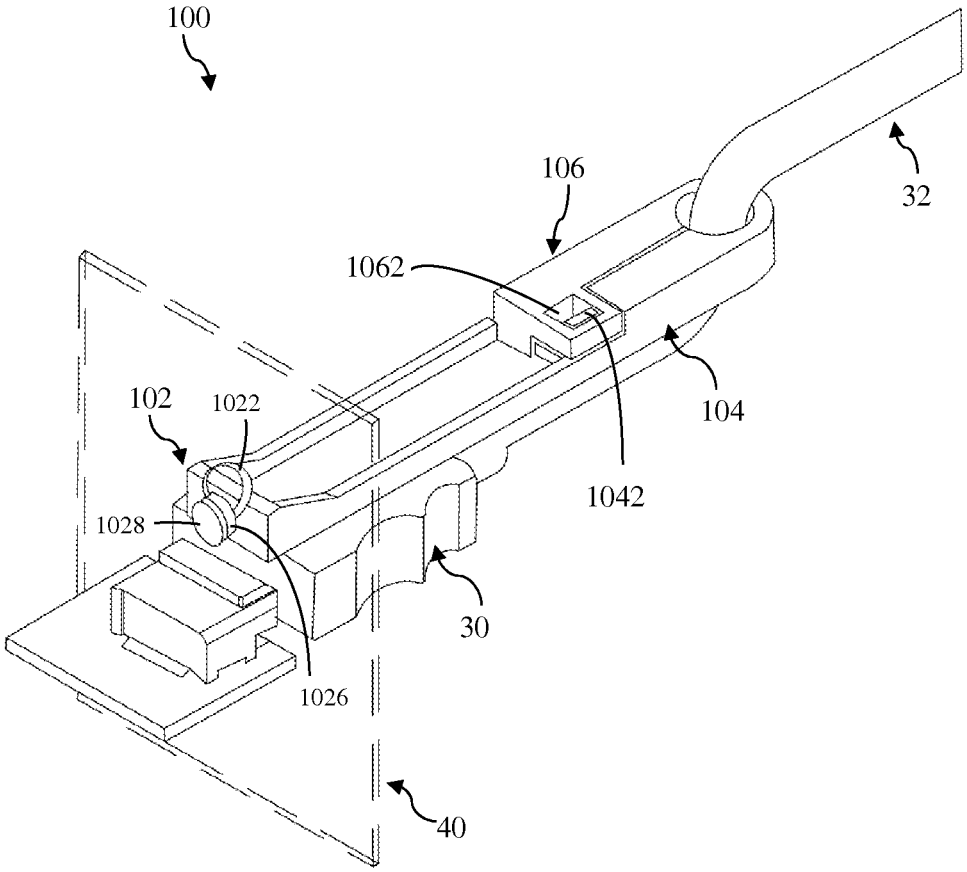
FIG. 4A illustrates a perspective view of the connection portion fixed on the housing according to an embodiment of the present invention.
Figure 4B:
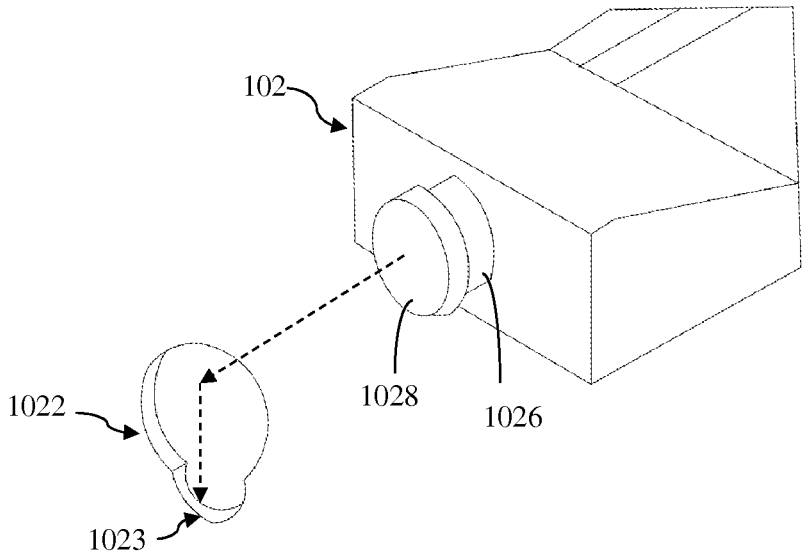
FIG. 4B illustrates an exploded view of the connection portion and the hole of the embodiment of FIG. 4A.

Please refer to FIG. 3, which shows another embodiment of the present invention. In this embodiment, the structure of the apparatus 100 is similar to the embodiment shown above. The difference therebetween is that there has a plurality of through holes 108 for clamping or constraining the cable 32 inserted therein. The size of through holes 108 are the same as or different from each other, so that the apparatus 100 can be adapted to different size of connector or plug, or different cable diameter. In alternative embodiment, a buffer material can be arranged around the inner wall of the through hole 108 to reduce the friction between the through hole 108 and the cable 32 or reduce the damage on the cable clamped by the through hole 108. The buffer material can be but is not be limited to polyethylene. In addition, in another embodiment, the first fixing portion 104 may include an adhesive portion to allow the user to adhere a label thereon for cable or connector recognition when a plurality of connectors are coupled to the electronic device. For instance, the label "HDMI 2" may indicate second HDMI, and there is no particular limitation on the type of the label.

Figure 5A:
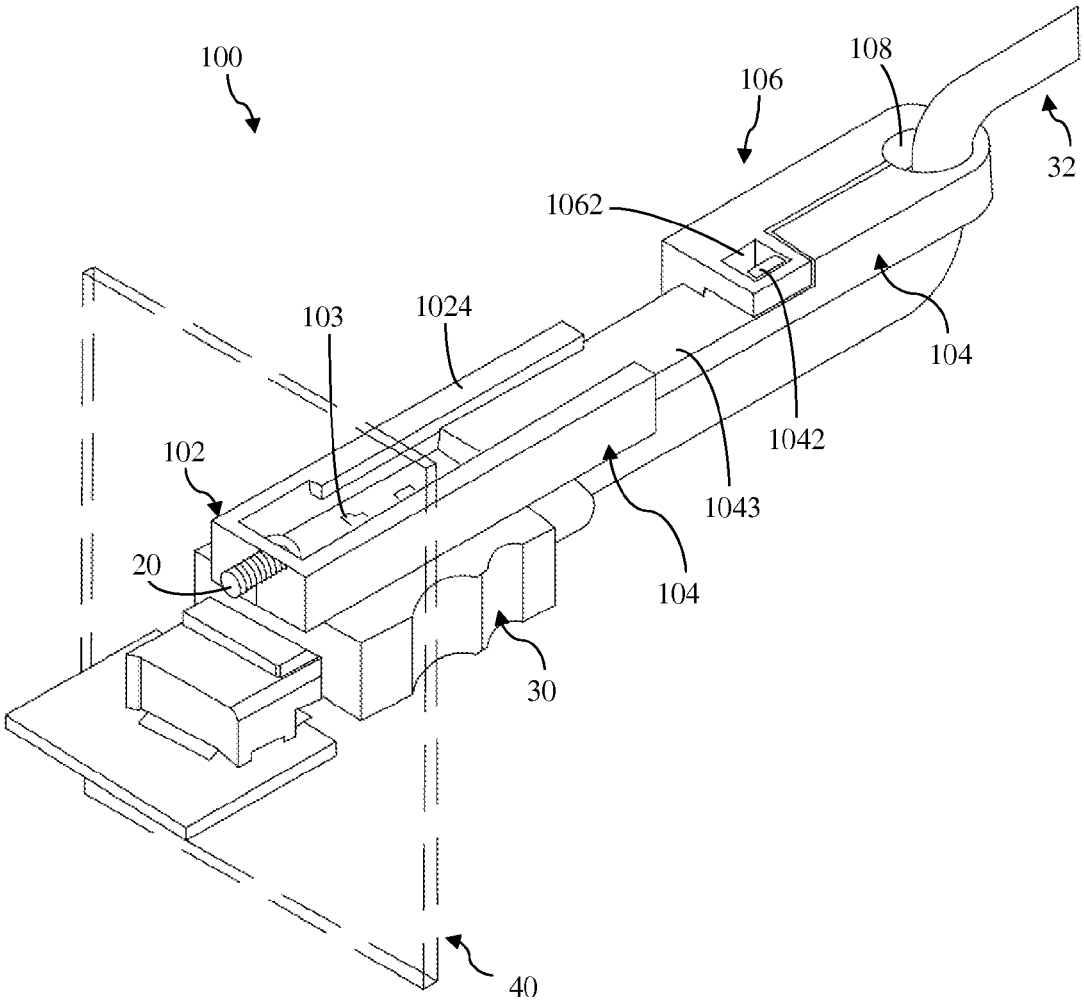
FIG. 5A illustrates a perspective view of an apparatus for fastening connectors according to the third embodiment of the present invention.
Figure 5B:
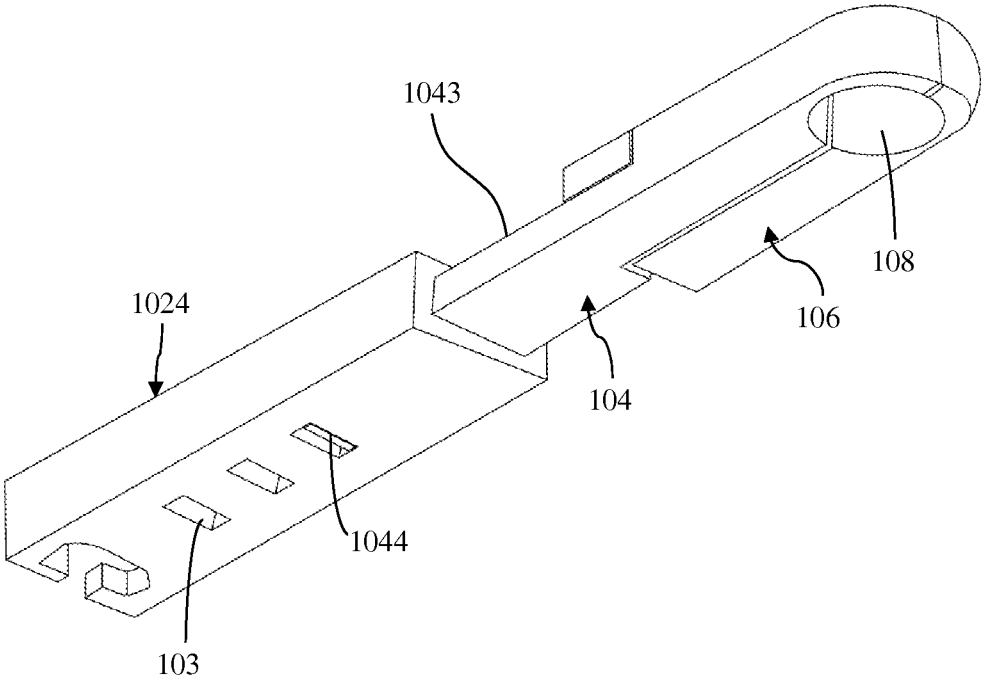
FIG. 5B illustrates a perspective view of an apparatus for fastening connectors according to the third embodiment of the present invention.

Please refer to FIG. 5A and FIG. 5B, which show an alternative embodiment of the connection portion 102 of the present invention. In this embodiment, the connection portion 102 may further include a hollow holder 1024 and an opening formed at the front of the holder 1024. The screw 20 is coupled to the housing 40 through the opening so that the holder 1024 can be secured on the housing 40. The holder 1024 further comprises a plurality of indentations (or holes) 103 which can be selectively arranged at the right, left bottom, or top side of the holder according to the need. In this embodiment, the trench 103 is positioned at the bottom side of the hollow holder 1024. The fixing portion 104 includes a sliding body 1043 arranged within the holder 1024. The sliding body 1043 includes at least one protrusion element 1044 arranged on a surface of the body 1043 corresponding to the plurality of indentations 103 for being inserted into the specific indentations thereby fixing the sliding body 1043 on the holder 1024. In another embodiment, the indentation 103 and protrusion element 1044 are respectively formed at the left or right side of the holder 1024 and the first fixing portion 104. The modification of indentations and protrusion element for achieving the same effect as the foregoing embodiment should be well understood by a person skilled in the art according to the need in use, thereby not being illustrated hereinafter.

In this embodiment, the apparatus 100 can be freely adjusted to particular dimension so that it's applicable to all kinds of plugs or cable. In another words, when the size of connector 30 is varied according to the need or different connector maker, the position of the protrusion element 1044 can be adjusted to an appropriate location by being inserted into an appropriate one of the indentations 103 so that the length of the apparatus 100 can be adjusted to fit different size of connector 30.

Figure 6A:
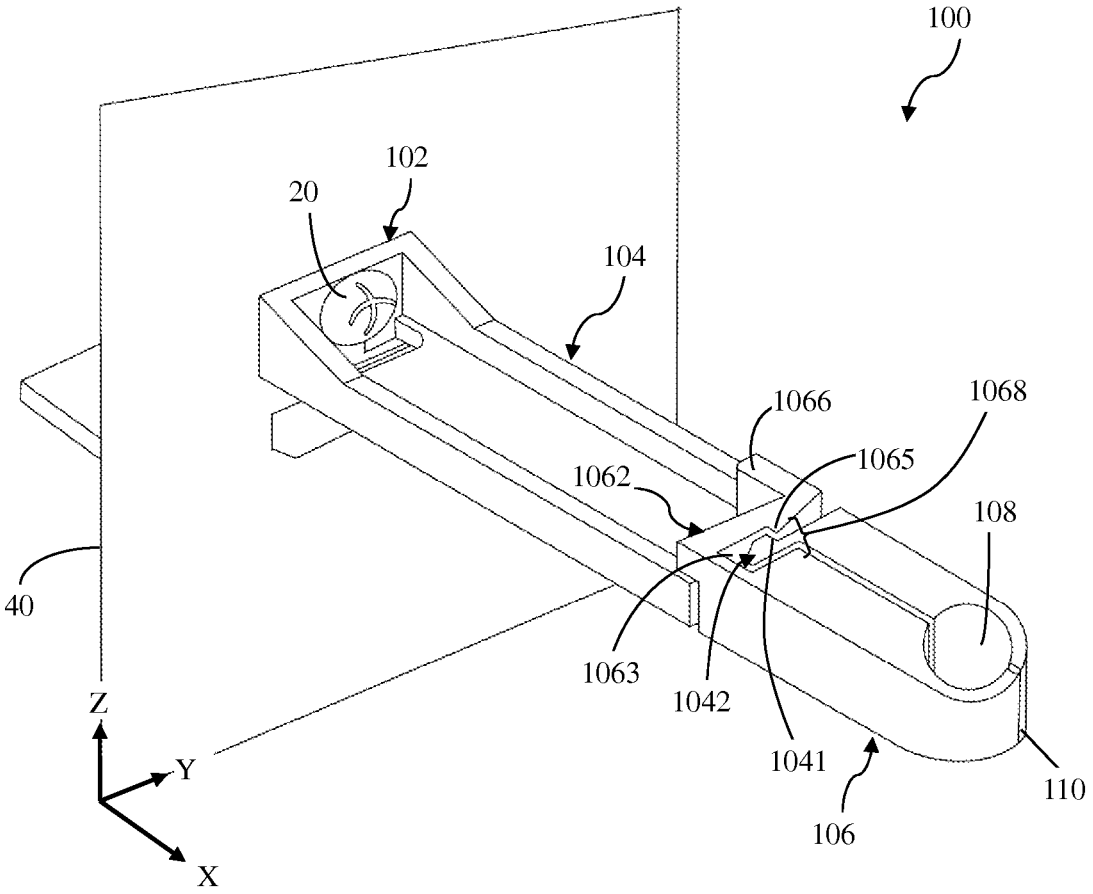
FIG. 6A illustrates a perspective view of an apparatus for fastening connectors according to the forth embodiment of the present invention.
Figure 6B:
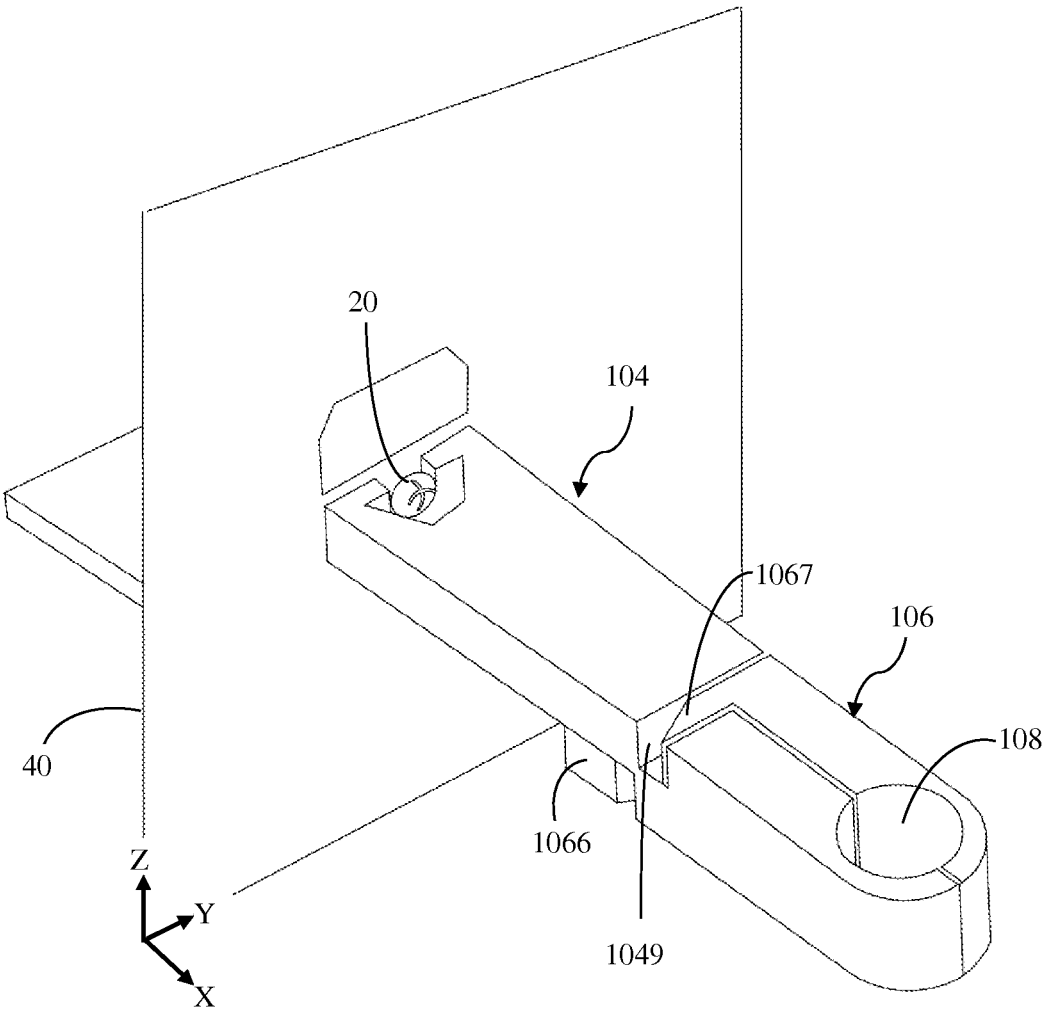
FIG. 6B illustrates a perspective view of an apparatus for fastening connectors according to the forth embodiment of the present invention.

With reference to FIG. 6A and FIG. 6B, the structure in this embodiment is similar to FIG. 1A. The difference therebetween is a structure of the first binding unit 1042 and the second binding unit 1062. In the present embodiment, the first binding unit has a hook 1041 extending from the first fixing portion 104. The hook 1041 has a protrusion part formed at the free end thereof. In the present embodiment, the protrusion part is a trapezoidal structure; however there is no particular limitation on the shape of the protrusion part. The second binding unit 1062 may include a cantilever arm 1066 extending from the second fixing portion 106. In the present embodiment, the cantilever arm 1066 is, but is not limited to, L-type. In addition, an accommodating space 1063 formed between the cantilever arm 1066 and the second fixing portion 106 is provided to accommodate the hook 1041 when the first fixing portion 104 is engaged with the second fixing portion 106. The cantilever arm 1066 further comprises a projection 1065 formed toward the accommodating space such that a neck port 1068 is formed at an opening of the accommodating space 1063, as shown in FIG. 7A. The width of the neck port 1068 is smaller than the opening of the accommodating space 1063 so that the projection 1065 can completely secure the hook 1041. Besides, the second binding unit 1062 may further comprise a pin structure 1067 and the first fixing portion 104 may further include a positioning groove 1049. When the hook 1041 is inserted into the accommodating space 1063 and is secured by the projection 1065, the pin structure 1067 can also be accommodated to the positioning groove 1049.

Figure 7B:
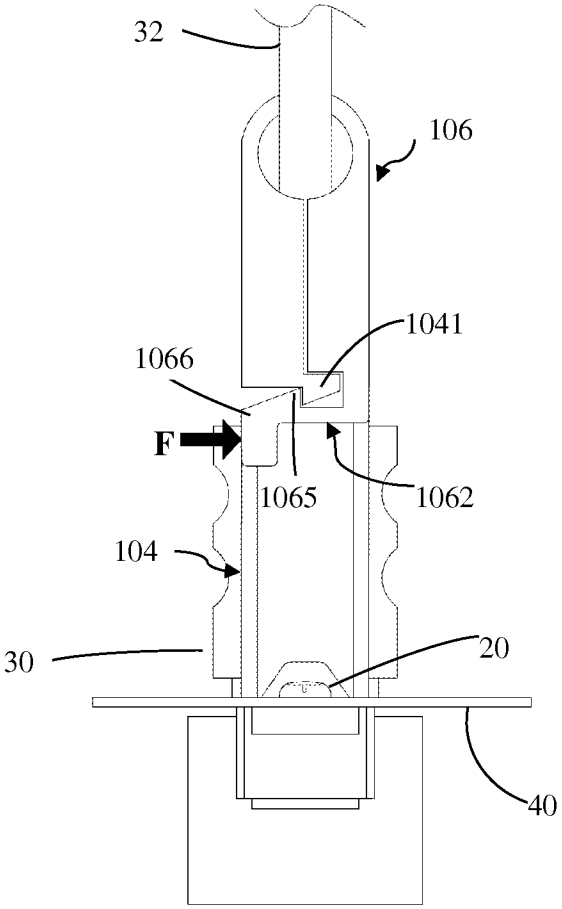
FIG. 7B illustrates a schematic view of an apparatus for fastening connectors according to the forth embodiment of the present invention.
Figure 7A:
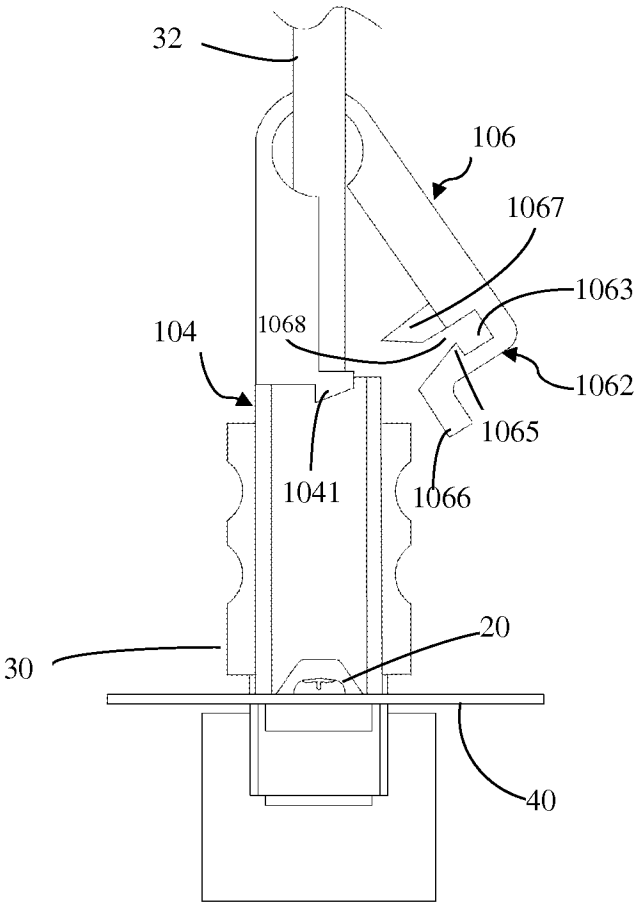
FIG. 7A illustrates a schematic view of an apparatus for fastening connectors according to the forth embodiment of the present invention.

Please refer to FIG. 7A and FIG. 7B which show diagrams of operation of fourth embodiment of the present invention. The hook 1041 passed through the neck port 1068 and is inserted into the accommodating space 1063 after pivoting the second fixing portion 106 to engage the first fixing portion 104. The projection 1065 contacts the side of the hook 1041 to restrict the second fixing portion 106 when the hook 1041 is inserted into the accommodating space 1063. As shown in FIG. 6A, FIG. 6B and FIG. 7B, when the hook 1041 is accommodated within the accommodating space, the pin structure 1067 is also inserted into the positioning groove 1049. Through the double locking mechanism including the first locking mechanism of the hook and the cantilever arm as well as the second locking mechanism of the pin structure and the positioning groove, it can prevent the second fixing portion 106 or the cantilever arm 1066 of the second binding unit 1062 from moving along the Z axial direction so as to cause the second binding unit 1062 to escape from the first fixing portion 104 when an a Z axial force is exerted on the second fixing portion 106 because the pin structure 1067 can be blocked by the positioning groove 1049 in Z direction. As shown in FIG. 7B, to release the second fixing portion 106 from the first fixing portion 104, a release force F is applied on the cantilever arm 1066 such that the cantilever arm 1066 can rotate along an axis (counter clockwise rotation around the Z axis in this example) whereby the projection 1065 no longer contacts the hook 1041, and the second fixing portion 106 can continue to rotate in counterclockwise direction automatically or manually release the cable 32 from the first fixing portion 104 and the second fixing portion 106. In one embodiment, the flexible element 110 as shown in FIG. 1B or 6B, can store the resilient force when the first fixing portion 104 is coupled to the second fixing portion 106. Therefore, when the release force F is applied on the cantilever arm 1066 to cause the projection 1065 to no longer contact the hook 1041, the resilient force can eject the second fixing portion 106 to rotate counterclockwise automatically.

The apparatus for fastening the connector includes the connection portion 102, the first fixing portion 104 and the second fixing portion 106. The cable 32 of the connector 30 can be enclosed into the through hole 108 between the first fixing portion 104 and the second fixing portion 106 by coupling the first fixing portion 104 onto the housing and engaging the first binding unit 1042 with the second binding unit 1062 to prevent the connector or plug from being loosened or detached by external force.

Various terms used in this disclosure should be construed broadly. For example, if an element "A" is said to be coupled to or with element "B," element A may be directly coupled to element B or be indirectly coupled through, for example, element C. When the specification states that a component, feature, structure, process, or characteristic A "causes" a component, feature, structure, process, or characteristic B, it means that "A" is at least a partial cause of "B" but that there may also be at least one other component, feature, structure, process, or characteristic that assists in causing "B." If the specification indicates that a component, feature, structure, process, or characteristic "may", "might", or "could" be included, that particular component, feature, structure, process, or characteristic is not required to be included. If the specification refers to "a" or "an" element, this does not mean there is only one of the described elements.

The foregoing descriptions are preferred embodiments of the present invention. As is understood by a person skilled in the art, the aforementioned preferred embodiments of the present invention are illustrative of the present invention rather than limiting the present invention. The present invention is intended to cover various modifications and similar arrangements included within the spirit and scope of the appended claims, the scope of which should be accorded the broadest interpretation so as to encompass all such modifications and similar structures.

What is claimed is:

1. A fastening apparatus for securing a connector to an electronic device, comprising:

a first fixing portion having a first binding unit;

a connection portion, coupled to the first fixing portion to connect the first fixing portion to a housing of the electronic device; and a second fixing portion pivotally connected with the first fixing portion, the second fixing portion comprising a second binding unit which is engaged with the first binding unit when the second fixing portion pivots to a specific location to form a through hole between the first fixing portion and the second fixing portion to allow a cable of the connector to pass through the through hole, wherein an axial direction of the through hole is perpendicular to a normal direction of a front surface of the housing, and wherein a pivotal axis of the second fixing portion is perpendicular to the normal direction of the front surface.

2. The apparatus of claim 1, wherein the connection portion comprises a first cylindrical structure coupled to a front end of the first fixing portion, and a second cylindrical structure coupled to the first cylindrical structure, wherein a diameter of the second cylindrical structure is greater than a diameter of the first cylindrical structure.

3. The apparatus of claim 1, wherein the connection portion comprises a through hole formed at a front end of the first fixing portion to allow a screw passing therethrough to fasten the first fixing portion to the housing.

4. A fastening apparatus for securing a connector to an electronic device, comprising:

a first fixing portion having a first concave part and an extension portion;

a connection portion, coupled to the extension portion of the first fixing portion to connect the first fixing portion to a housing of the electronic device; and a second fixing portion pivotally connected to the fixing portion unit and engaged with the first fixing portion when the second fixing portion pivots to a specific location to form a through hole between the first concave part and the second fixing portion for enclosing a cable of the connector in the through hole, wherein a central axis of the through hole is parallel to a normal direction of a front surface of the housing, wherein the extension portion and the connection portion are entirely located on one side of a plane that passes through the central axis of the through hole, and wherein a pivotal axis of the second fixing portion is parallel to the normal direction of the front surface.

5. The apparatus of claim 1, wherein a buffer material is formed within the through hole.

6. A fastening apparatus for securing a connector to an electronic device, comprising:

a first fixing portion having a first binding unit;

a connection portion, coupled to the first fixing portion to connect the first fixing portion to a housing of the electronic device; and a second fixing portion pivotally connected with the first fixing portion, the second fixing portion having a second binding unit which is engaged with the first binding unit when the second fixing portion pivots to a specific location such that a cable of the connector is enclosed between the first fixing portion and the second fixing portion, wherein the connection portion comprises a holder for receiving the first fixing portion and wherein a location of the first fixing portion on the holder is adjustable.

7. The apparatus of claim 6, wherein a side of the holder comprises a plurality of indentations, and wherein the first fixing portion further comprises a protrusion element, wherein the first fixing portion is adjustable to different positions on the holder when the protrusion element is inserted into different indentations.

8. The apparatus of claim 1, wherein the first fixing portion and the second fixing portion are integrally formed through a flexible element, wherein a material for forming the flexible element is the same as a material for forming the first and second fixing portion.

9. The apparatus of claim 1, wherein the first binding unit has a protrusion structure and the second binding unit has a hole structure allowing the protrusion structure to be matched therein.

10. The apparatus of claim 1, wherein the second binding unit has a protrusion structure and the second binding unit has a hole structure allowing the protrusion structure to be matched therein.

11. The apparatus of claim 1, wherein the first binding unit has a hook and the second binding unit has a cantilever arm, wherein an accommodating space is defined by the cantilever arm and the second fixing portion for allowing the hook to be inserted therein, and wherein the cantilever arm further comprises a projection formed toward the accommodating space to form a neck port at an opening of the accommodating space.

12. The apparatus of claim 11, wherein the second binding unit further comprises a2 positioning pin structure and the first binding unit further comprises a positioning groove, and the positioning pin structure is inserted into the positioning groove when the first binding unit is engaged with the second binding unit.

13. The apparatus of claim 4, wherein the connection portion comprises a first cylindrical structure coupled to a front end of the first fixing portion, and a second cylindrical structure coupled to the first cylindrical structure, wherein a diameter of the second cylindrical structure is greater than a diameter of the first cylindrical structure.

14. The apparatus of claim 6, wherein the connection portion comprises a first cylindrical structure coupled to a front end of the first fixing portion, and a second cylindrical structure coupled to the first cylindrical structure, wherein a diameter of the second cylindrical structure is greater than a diameter of the first cylindrical structure.

15. The apparatus of claim 4, wherein the connection portion comprises a through hole formed at a front end of the first fixing portion to allow a screw passing therethrough to fasten the first fixing portion to the housing.

16. The apparatus of claim 6, wherein the connection portion comprises a through hole formed at a front end of the first fixing portion to allow a screw passing therethrough to fasten the first fixing portion to the housing.

17. The apparatus of claim 4, wherein a buffer material is formed within the through hole.

18. The apparatus of claim 6, wherein a buffer material is formed within the through hole.

19. The apparatus of claim 4, wherein the first fixing portion and the second fixing portion are integrally formed through a flexible element, wherein a material for forming the flexible element is the same as a material for forming the first and second fixing portion.

20. The apparatus of claim 6, wherein the first fixing portion and the second fixing portion are integrally formed through a flexible element, wherein a material for forming the flexible element is the same as a material for forming the first and second fixing portion.

* * * * *